US008752226B2

(12) United States Patent
Erlich et al.

(10) Patent No.: US 8,752,226 B2
(45) Date of Patent: Jun. 17, 2014

(54) AXLE CONTROLLER FOR AUTOMATED SWIMMING POOL CLEANERS

(75) Inventors: Giora Erlich, North Caldwell, NJ (US); Joseph Porat, Del Ray Beach, FL (US); Seth Chilton, West Orange, NJ (US)

(73) Assignee: Aqua Products, Inc., Cedar Grove, NJ (US)

( * ) Notice: Subject to any disclaimer, the term of this patent is extended or adjusted under 35 U.S.C. 154(b) by 256 days.

(21) Appl. No.: 13/305,024

(22) Filed: Nov. 28, 2011

(65) Prior Publication Data

US 2013/0133144 A1 May 30, 2013

(51) Int. Cl.
*E04H 4/16* (2006.01)

(52) U.S. Cl.
USPC ..... 15/1.7

(58) Field of Classification Search
USPC ..... 15/1.7
See application file for complete search history.

(56) References Cited

U.S. PATENT DOCUMENTS

| | | | | |
|---|---|---|---|---|
| 3,229,315 | A * | 1/1966 | Watson | 15/1.7 |
| 3,979,788 | A * | 9/1976 | Strausak | 15/1.7 |
| 4,348,192 | A * | 9/1982 | Pansini | 440/38 |
| 6,742,613 | B2 * | 6/2004 | Erlich et al. | 180/21 |
| 7,213,287 | B2 * | 5/2007 | Hui | 15/1.7 |
| 8,241,430 | B2 * | 8/2012 | Erlich et al. | 134/18 |

* cited by examiner

*Primary Examiner* — Shay Karls
(74) *Attorney, Agent, or Firm* — Abelman, Frayne & Schwab

(57) ABSTRACT

A pool cleaner includes a housing having a front, rear and adjoining side portions and a base plate having a water inlet. A pump is configured to draw water and debris from the pool through the inlet for filtering and discharge filtered water through an outlet. A pair of wheels are coupled proximate the front and rear of the housing, each of which is coupled to an opposing end of an axle, each opposing end of the axle being slidably moveable along the housing in a forward and rearward directional path of the cleaner in response to a steering assembly. An on-board controller includes memory for storing a cleaning program, and a processor electrically coupled to the memory to execute the cleaning program to automatically control the steering assembly to position each end of the axles to steer the cleaner while it is moving in a forward or reverse direction.

21 Claims, 11 Drawing Sheets

FIG. 1
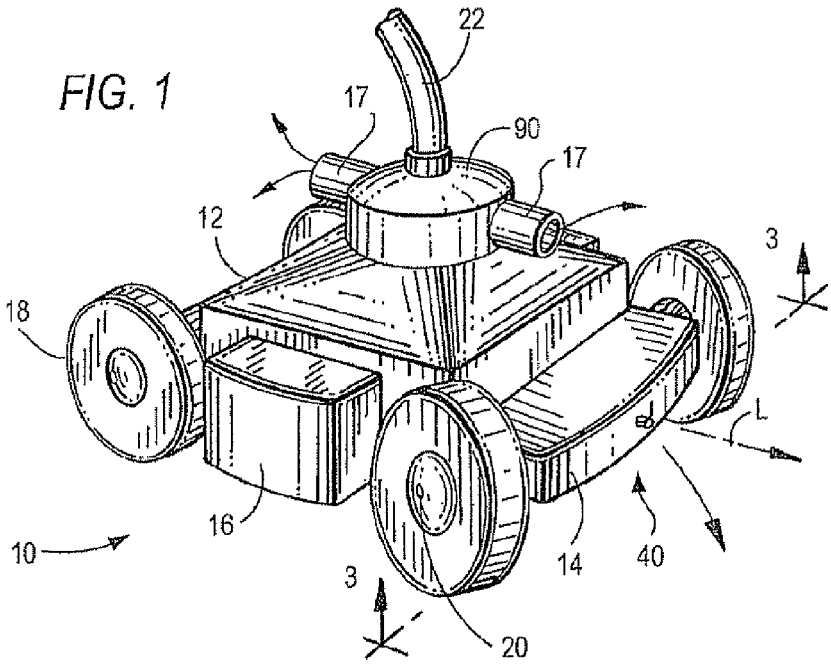
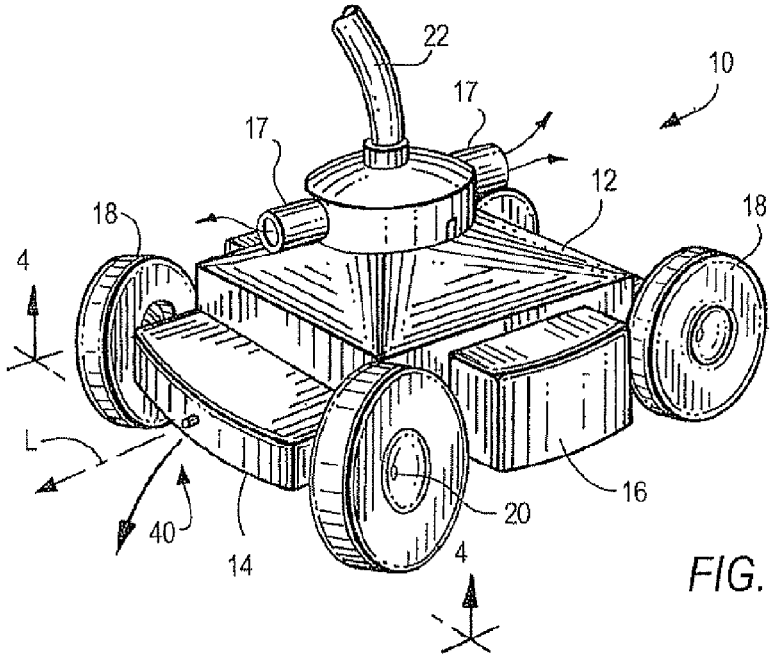
FIG. 2

FIG. 3
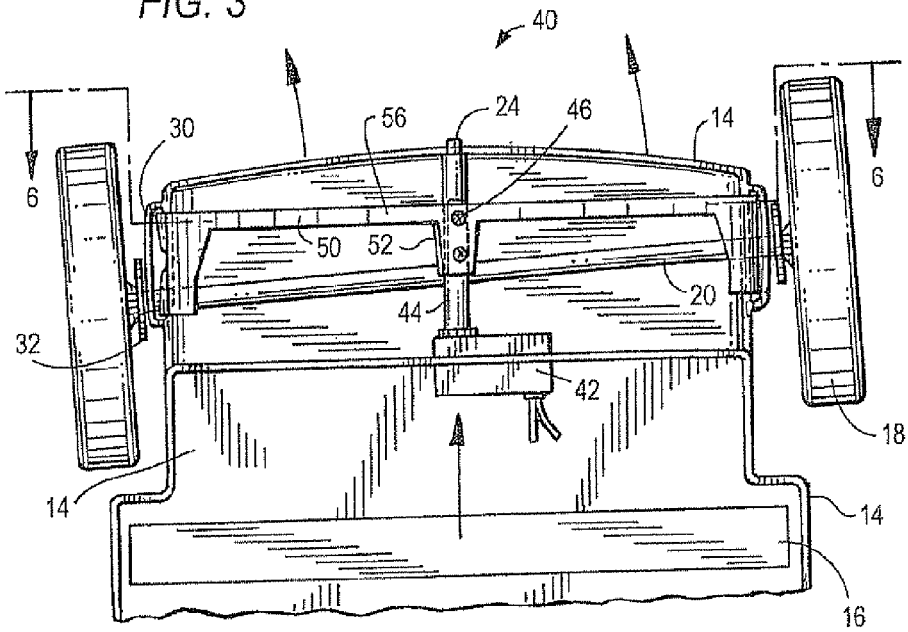
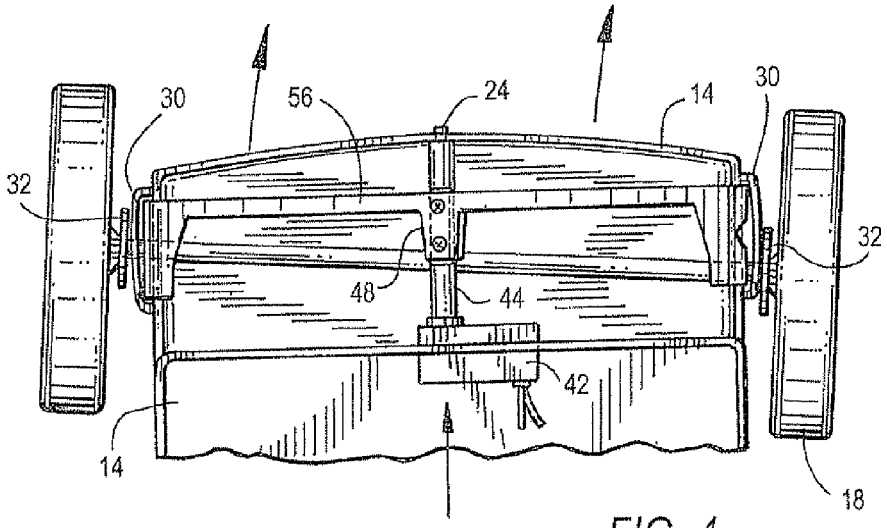
FIG. 4

FIG. 12
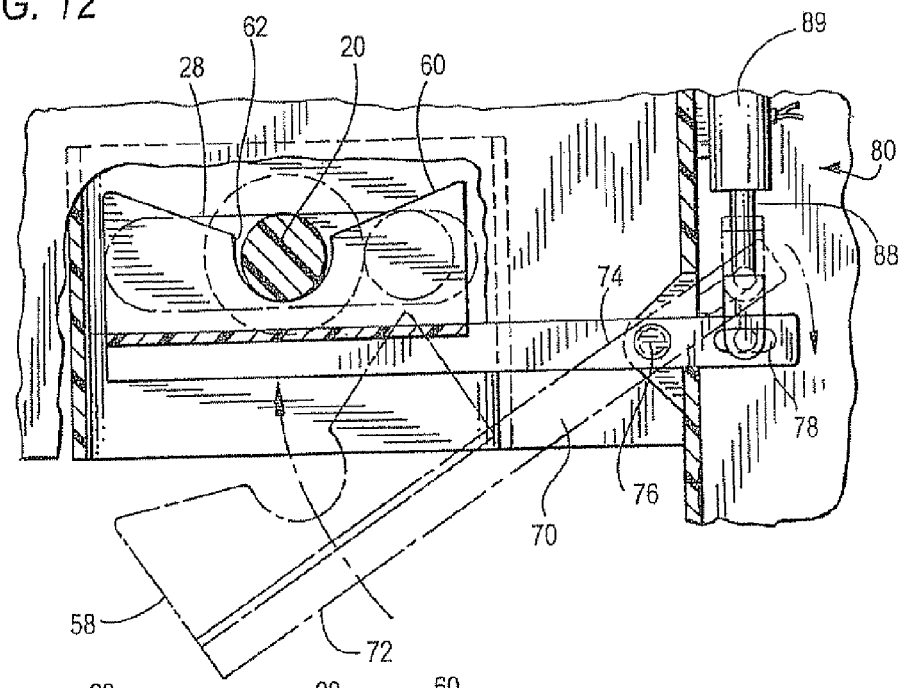
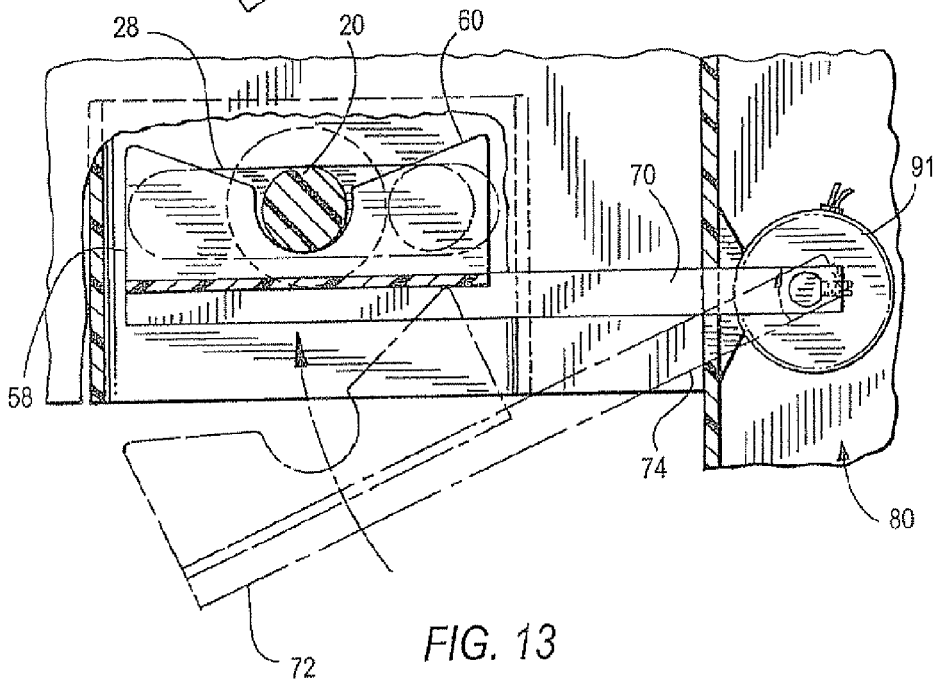
FIG. 13

AXLE CONTROLLER FOR AUTOMATED SWIMMING POOL CLEANERS

FIELD OF THE INVENTION

The present invention relates to methods and apparatus for controlling the scanning or traversing patterns of an automated robotic pool and tank cleaner with respect to the bottom and sidewalls of the pool or tank, and more specifically to methods and apparatus for controlling the steering of the pool cleaner along the bottom and sidewalls of the pool or tank.

BACKGROUND OF THE INVENTION

Automated or robotic self-propelled swimming pool cleaners traditionally contact and move about on the pool surfaces being cleaned on axle-mounted wheels or on endless tracks that are powered by a separate drive motor through a gear train. The wheels or tracks are aligned with the longitudinal axis of the cleaner. Swimming pool cleaning robots that move on wheels generally have two electric motors, a pump motor that provides power to a water pump that is used to dislodge and/or vacuum debris up into a filter, and a drive motor which is used to propel the robot over the surfaces of the pool that are to be cleaned. The drive motor can be connected through a gear train directly to one or more wheels or axles, or through a belt and pulleys to propel the cleaner; or to a water pump, which can be external to the robotic cleaner that produces a pressurized stream, or water jet, that moves the cleaning apparatus by reactive force or by driving a water turbine connected via a gear train to the wheels or endless track. The movement of the pool cleaners of the prior art, when powered by either the turbine or the direct or reactive jet is in one direction and the movement is random.

Control of the longitudinal directional movement of the pool cleaner can be accomplished by elaborate electronic circuitry, as is the case when stepper and D.C. brushless motors are employed. Other control systems enable the cleaner to climb the vertical sidewall of the pool until a portion of the cleaner extends above the waterline and/or the unit has moved laterally along the sidewall, after which the motor drive reverses and the cleaner returns to the bottom surface of the pool along a different path. The water-powered cleaners of the prior art also rely on the reorientation of the cleaner while in contact with the wall to effect a random change in direction. However, under certain circumstances, it is a waste of time and energy, and produces unnecessary wear and tear to have the robotic cleaner climb the sidewall solely for purpose of changing the direction of movement of the cleaner.

It has also been proposed to direct the scanning movement of a pool cleaner mechanically by use of a three-wheeled array in which the third wheel is mounted centrally and opposite the other pair of wheels, and the axle upon which the third wheel is mounted is able to rotate in a horizontal plane around a vertical axis. A so-called free-wheeling version of this apparatus is shown on U.S. Pat. No. 3,979,788.

In U.S. Pat. No. 3,229,315, the third wheel is mounted in a plate and the plate is engaged by a gear mechanism that positively rotates the horizontal axle and determines the directional changes in the orientation of the third wheel.

It is also known in the prior art to provide a pool cleaner with a vertical plunger or piston that can be moved by a hydraulic force into contact with the bottom of the pool to cause the cleaner to pivot and change direction. The timing must be controlled by a pre-programmed integrated circuit ("IC") device.

It is also known from U.S. Pat. No. 4,348,192 to equip the feed water hose of a circular floating pool cleaning device with a continuous discharge water jet nozzle that randomly reorients itself to a reversing direction when the forward movement of the floating cleaner is impeded. In addition to the movable water jet discharge nozzle attached to the underside of the floating cleaner, the hose is equipped with a plurality of rearwardly-facing jet nozzles that move the water hose in a random pattern and facilitate movement of the cleaner.

Commercial pool cleaners of the prior art that employ pressurized water to effect random movement have also been equipped with so-called "back-up" valves that periodically interrupt and divert the flow of water to the cleaner and discharge it through a valve that has jets facing upstream, thereby creating a reactive force to move the hose and, perhaps, the attached cleaner in a generally backward direction. The back-up valve can be actuated by the flow of water through a fitting attached to the hose. The movement resulting from the activation of the back-up valve jets is also random and may have no effect on reorienting a cleaner that has become immobilized, e.g., in the corner of the pool or by a ladder or other obstruction.

The apparatus of the prior art for use in propelling and directing the scanning movement of automated robotic pool cleaners is lacking in several important aspects. For example, the present state-of-the-art machines employ pre-programmed, integrated circuit ("IC") devices that produce a specific predetermined scanning pattern. The design and production of these IC devices is relatively expensive and the scanning patterns produced have been found to be ineffective in pools having irregular configurations and/or obstructions built into their bottoms or sidewalls.

Cleaners propelled by a water jet discharge move only in a generally forward direction, and their movement is random, such randomness being accentuated by equipping the unit with a flexible hose or tail that whips about erratically to alter the direction of the cleaner.

Cleaners equipped with gear trains for driving wheels or endless tracks represent an additional expense in the design, manufacture and assembly of numerous small, precision-fit parts; the owner or operator of the apparatus will also incur the time and expense of maintaining and securing replacement parts due to wear and tear during the life of the machine. A cleaning apparatus constructed with a pivotable third wheel that operates in a random fashion or in accordance with a program has the same drawbacks associated with the production, assembly and maintenance of numerous small moving parts.

The robotic pool cleaners of the prior art are also lacking in mechanical control means for the on-site adjustment of the scanning patterns of the apparatus with respect to the specific configuration of the pool being cleaned.

In U.S. Pat. No. 6,742,613, a self-propelled robotic pool cleaner includes a reversible drive means for propelling the apparatus in opposite directions, which directions correspond generally to the longitudinal axis of the apparatus, and a pair of wheels assembled to each of the opposite longitudinal ends of the cleaner. Each pair of wheels are mounted to transverse axles, which are manually positioned and secured at an angle that is acute to the longitudinal axis of the apparatus when the cleaner is moving in at least one direction. In an embodiment, the axles are mounted in slots formed in the base of the housing, and one or more manually adjustable pins are provided to fix and/or change the range of movement of the axle in the slot. These adjustments allow the operator to customize the pattern based upon the size and/or configuration of the specific pool being cleaned. In this manner, the cleaner moves in a clockwise or counter-clockwise direction until the operator manually adjusts the pin positioning to thereby change the angle of the axle with respect to the longitudinal axle.

European Patent No. EP 1,472,425 discloses a swimming pool cleaner that includes wheels fixedly connected to an axle which is transversely mounted through elongated slots formed in the sidewalls of the cleaner proximate each wheel. The axle is mounted on a central pivot that allows the axle to move forward and backward within the physical constraints of the opposing ends of the elongated slots. A rotating fork having two projections, one on either side of the axle must be manually set to provide different steering paths for the cleaner.

A significant deficiency in the design and operation of the pool cleaners of the prior art is their tendency to become immobilized, e.g., in sharp corners, on steps, or even in the skimmer intake openings at the surface of the pool. In such circumstances, the pool cleaner has limited mobility at best, or is incapable of traversing and cleaning the surface of the pool in a worst case scenario.

Yet another significant deficiency in the design and operation of pool cleaners of the prior art is the entanglement or twisting of the buoyant power cable that provides power from an external power source to the cleaner. In particular, as the cleaner turns during cleaning operations, the floating portion of the power cable can become twisted as it helically winds in a counter-clockwise or clockwise direction. The undesirable twisting or coiling of the power cable shortens the length of the power cable, exerts forces on the cleaner that can oppose the movement of the cleaner, as well as places undesirable stresses on the electrical contacts between the power cable and the cleaner.

Swivel connections have been mounted on the top of the cleaner in an attempt to reduce the coiling of the power cable as the cleaner turns. Unfortunately, the swivel mounts do not always prevent the undesirable coiling of the power cable during the continuous turning of the cleaner.

SUMMARY OF THE INVENTION

The above objectives are met by the embodiments of the apparatus and methods described below. In the description that follows, it will be understood that the cleaner moves on supporting wheels, rollers or tracks that are aligned with the longitudinal axis of the cleaner body when it moves in a straight line. References to the front or forward end of the cleaner will be relative to its then-direction of movement.

The present invention is directed to various embodiments of steering assemblies for turning the pool cleaner to avoid obstacles as it cleans the pool surfaces, as well as to prevent undesirable coiling of the power cable that provides power to the cleaner. In one embodiment, left and right wheels can be mounted on independently separate axles or on opposing ends of a common axle. Each end of the axle near the corresponding wheel extends through an elongated slot that enables each axle end to move forward and backwards within the physical constraints of the slot. The positioning of each axle end within the slot controls the turning, i.e., steering of the cleaner. When both axle ends are free to move to the rearmost end of the slot when the cleaner is moving forward, the cleaner will move substantially straight along its longitudinal axis. To turn the cleaner to the right while moving in the forward direction, the left end of the axle is secured in a forward position within its corresponding elongated slot, while the right end of the axle is positioned at the rearmost position of its corresponding slot. In this manner, the forward positioning of the left axle and wheel turns the cleaner to the right. Similarly, to turn the cleaner to the left while moving in the forward direction, the right end of the axle is secured in a forward position within its corresponding elongated slot, while the left end of the axle is positioned at the rearmost position of its corresponding slot. In this manner, the forward positioning of the right axle and wheel turns the cleaner to the left.

In general, a self-propelled robotic cleaning apparatus for cleaning a submerged surface of a pool or tank can include a housing having a front portion, an opposing rear portion and adjoining side portions defining the periphery of the apparatus. A base plate with at least one water inlet is mounted to the lower portion of the housing. A water pump can be mounted in the interior of the housing. The water pump is configured to draw water and debris from the pool or tank through the at least one water inlet for filtering and discharging filtered water through at least one water-discharge outlet. Alternatively, the water pump can be remote from the cleaner and connected by a hose. Rotationally-mounted supports are coupled proximate the front and rear portions of the housing. The rotationally-mounted supports include a pair of rotationally-mounted supports each of which is coupled to an opposing end of an axle, and each opposing end of the axle is slidably moveable along the housing in a forward and rearward directional path of the cleaner. The cleaning apparatus of the invention includes a steering assembly for directing movement of the axle ends in response to receiving control signals from a controller. The controller includes a memory for storing a cleaning program and a processor electrically coupled to the memory. The cleaning program is executable by the processor and operable to automatically control predetermined functions, such as stopping and starting the pump and/or drive motor(s), and the like. The on-board processor/controller also controls automatically, or in response to a user's remote signal, the positioning of each end of the axle to steer the cleaning apparatus while the cleaner is moving in a forward or reverse direction.

In one embodiment, the steering assembly includes at least one upright flange guide positioned proximate a respective axle end. Each flange has a top surface that selectively engages with and disengages from the axle end. The at least one flange guide can include an inclined top surface that is provided with at least one axle groove that is formed in the top surface. The groove is sized to circumscribe at least a portion of the axle end and secure the axle end in a selected position along the directional path. The inclined top surface helps guide the axle into the axle groove. Preferably, the at least one axle groove is a single groove positioned intermediate the ends of the top surface. Alternatively, a plurality of axle grooves are formed in spaced apart relation in the top surface of the flange.

In another aspect of the invention, the at least one upright flange guide includes a pair of opposing upright flange guides. Each flange guide is respectively coupled to an opposing end of a cross-member extending transversely to the longitudinal axis of the cleaner. The transverse cross-member is mounted at its middle to a rotatable shaft that is mounted on the housing. Rotation of the shaft is controlled by the controller. Preferably, the cross-member is flexible and is bowed downward from the middle of the rotatable shaft. Illustratively, the shaft is rotatable in a range of from five to fifteen degrees in the clockwise and counter-clockwise directions to enable the engagement and disengagement of the flanges with the corresponding ends of the axle.

Each opposing end of an axle extends through a corresponding elongated slot formed in the side portions of the housing. The slots are orientated substantially horizontally with respect to the surface being cleaned and sized to enable forward and rearward directional movement of the axle end therein. Preferably, each elongated slot is formed in an inner sidewall of the side portion of the housing. Alternatively, other range-defining members, such as fixed or adjustable pins, or other fixed or movable structural members can be attached to the cleaner housing or other supporting structure that is provided for that purpose, to define and limit the forward and rearward axle movement The cleaning apparatus can further include an outer axle stabilizing sidewall mounted over and adjacent to the inner sidewall to form a receiving channel therebetween. The outer stabilizing sidewall includes an outer slot configured to align with the elongated slot of the inner sidewall, and also receive the opposing end of the axle there-through. Further, the receiving channel is configured to receive a corresponding upright flange guide.

In yet another embodiment, each upright flange guide is mounted to a shaft extending along the longitudinal axis of the cleaner. Each shaft has a free end coupled to a means for rotating the upright flange guide to engage and disengage from a corresponding axle end. In one aspect, the means for rotating includes one of a piston and a servo motor. In this manner, each flange engages and disengages a corresponding end of the axle independently from the other.

In another embodiment, each opposing end of the axle is controlled by one or more solenoids having an extendible and retractable shaft having a free end that engages the axle end directly or through one or more gears or levers, and which slidably extends and retracts parallel to the longitudinal axis L of the cleaner to selectively move the axle end along the forward and rearward directional path. In this manner, each axle end can be independently retained along any position within the corresponding slot.

In still another embodiment of the cleaning apparatus, the steering assembly includes a steering control link having opposing ends, each of which control link ends is pivotally coupled to the opposing axle ends. A worm gear drive is fixedly connected to the steering control link and configured to receive electrical signals from the controller to move the steering control link laterally to thereby steer the rotationally-mounted supports in a selected direction. In one aspect, each opposing end of the steering control link and each axle end is coupled through an associated steering arm.

In yet another embodiment, a self-propelled robotic cleaning apparatus for cleaning a submerged surface of a pool or tank includes a housing having a front portion, an opposing rear portion and adjoining side portions defining the periphery of the apparatus, and a base plate with at least one water inlet. A water pump is mounted in the interior of the housing, and the water pump is configured to draw water and debris from the pool or tank through the at least one water inlet for filtering and discharging filtered water through at least one water-discharge outlet A rotationally-mounted support is coupled proximate one of the front or rear portions of the housing by a yoke, and the yoke and rotationally-mounted support are simultaneously rotatable about a central axis of an axle which is mounted to the housing of the cleaner. A controller includes a memory for storing a cleaning program and a processor electrically coupled to the memory. The cleaning program is executable by the processor and operable to automatically control rotation of the axle to steer the cleaning apparatus while the cleaner is moving in a forward or reverse direction.

In one aspect, a solenoid is coupled to the yoke. The solenoid is electrically coupled to the controller and operable to receive command signals to rotate the yoke and rotationally-mounted support about the axle. Further details of the invention are illustratively shown and described below with respect to the drawings and detailed description of the embodiments.

BRIEF DESCRIPTION OF THE DRAWINGS

The invention will be described in further detail below and with reference to the attached drawings in which:

FIG. 1 is a top, right side perspective view of a pool cleaner illustrating the forward directional wheels being turned to the right by a steering assembly of the present invention;

FIG. 2 is a top, left side perspective view of the pool cleaner of FIG. 1 illustrating the forward directional wheels being turned to the left by the steering assembly of the invention;

FIG. 3 is a bottom, plan, sectional view taken along lines 3-3 of the pool cleaner of FIG. 1 illustrating the forward directional wheels being controlled by the steering assembly to turn the cleaner to the right;

FIG. 4 is a bottom, plan, sectional view taken along lines 4-4 of the pool cleaner of FIG. 2 illustrating the forward directional wheels being controlled by the steering assembly to turn the cleaner to the left;

FIG. 12 is a side elevation view, partly in cross-section, illustrating a second embodiment of the steering assembly having an electro-mechanical device for controlling an upright flange guide for locking and unlocking an end of a wheel axle extending through the slotted channel;

FIG. 13 is a side elevation view, partly in cross-section, illustrating a third embodiment of the steering assembly having an electro-mechanical device for controlling the upright flange guide for locking and unlocking an end of a wheel axle extending through the slotted channel;

Figure 5:
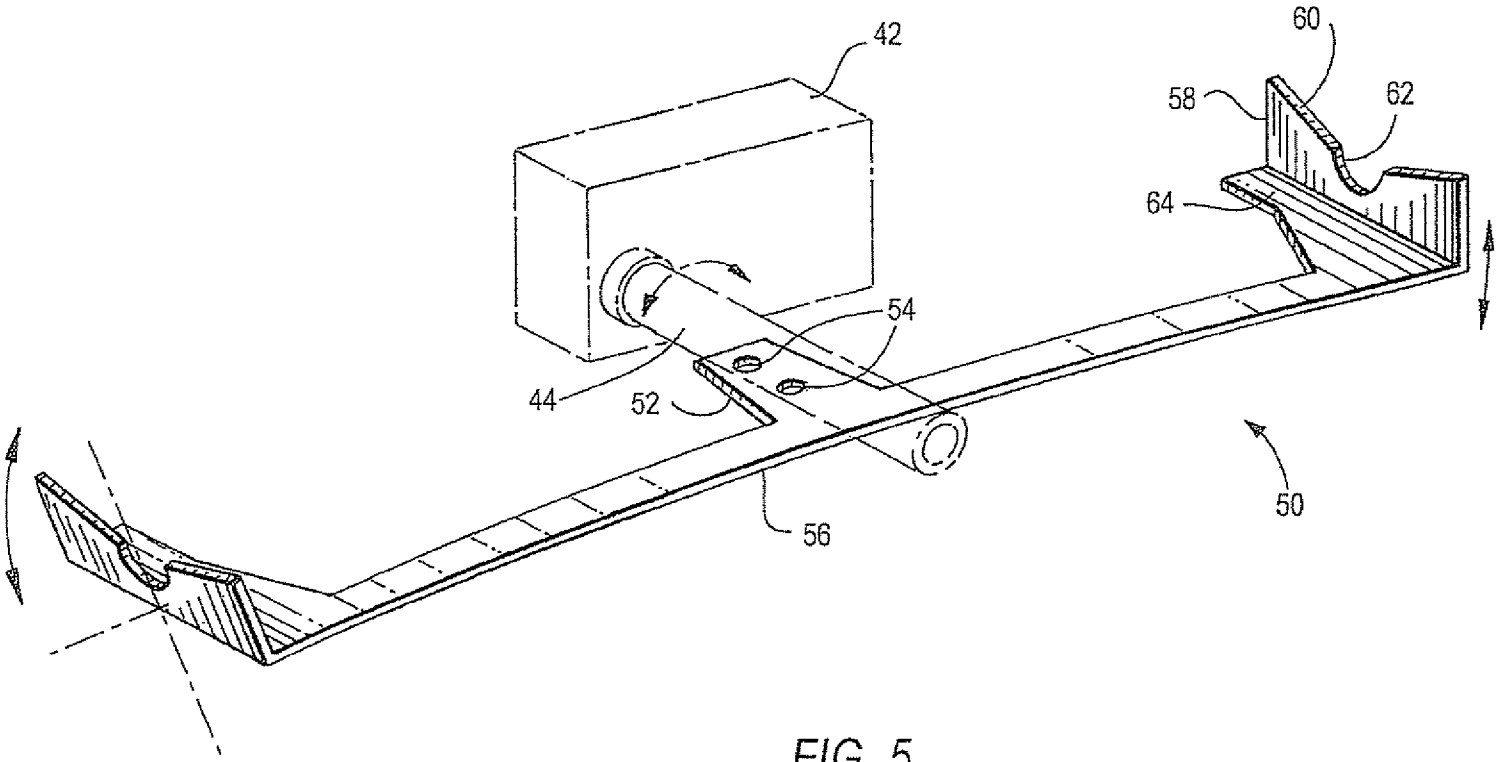
FIG. 5 is a top right side perspective of a bowed cross-member of the steering assembly of FIG. 3.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DESCRIPTION OF THE PREFERRED EMBODIMENTS

A conventional pool cleaner comprises a housing that includes a top and depending sidewalls which enclose one or more drive motor(s) for propelling the apparatus via rotatable supports, such as wheels an/or tracks. A base plate is secured beneath the housing and one or more types of filter media are positioned internally and/or externally with respect to the housing base plate. Optionally, a pump and at least one motor for driving the pump are mounted in the interior of the housing. Power is supplied by a buoyant electrical cable attached to an external power source, such as a transformer or a battery contained in a floating housing at the surface of the pool. Pressurized water can also be provided via a hose for water turbine-powered cleaners.

An electro-mechanical steering assembly automatically controls the direction of movement of the cleaner, including its turning patterns, to prevent undesirable twisting and/or knotting of the power cable, as well as to prevent immobilization of the cleaner due to obstacles, such as ladders, corners, steps and/or other structures that may be in the path of the cleaner. The invention also has application to tank and pool cleaners which operate in conjunction with a remote pump and/or filter system which is located outside of the pool and in fluid communication with the cleaner via a hose that carries the water.

Control means are provided to periodically reverse the propelling means to assure that the cleaner does not become immobilized, e.g., by an obstacle in the pool. If, for example, the pool cleaner does not change its orientation with respect to the bottom or sidewall as indicated by a signal from an on-board mercury switch indicating that such transition has occurred during the prescribed period, e.g., three minutes, the control circuit will automatically change the direction of the drive means in order to permit the cleaner to move away from the obstacle and resume its scanning pattern. In a preferred embodiment of the invention, the predetermined delay period between auto-reversal sequences is adjustable by the user in the event that a greater or lesser delay cycle time is desired. Sensors, such as magnetic and infrared responsive signaling devices can also be provided to change the direction of movement in response to prescribed conditions, e.g., absence of forward movement due to an obstacle. In addition, the control means automatically steers the cleaner to the right or left while moving in either the forward or reverse direction, as discussed below in further detail.

FIGS. 1 and 2 are perspective views of a submersible robotic pool cleaner 10 moving in a forward direction along the cleaner's longitudinal axis "L". In the description that follows, the pool cleaner 10 has an exterior cover or housing 12 with an internal pump (not shown) and drive motor 90 that draws water and debris through one or more water inlets 16 formed in a base plate 14 that are entrained by a filter (not shown). Alternatively, the pump and/or filter can be external to the cleaner (not shown). One or more discharge outlets 17 can be provided to discharge filtered water from the cleaner, as well as form a pressurized water jet to propel the cleaner 10 in a forward or reverse direction. In one embodiment, the water is drawn from beneath the apparatus and passed through at least one filter medium to remove debris and is forced by a pump through a directional discharge conduit 17 which is aligned with the longitudinal axis of the pool cleaner. The resulting or reactive force of the discharged water jet propels the cleaner in the opposite direction. The water jet can be diverted by various means and/or divided into two or more streams that produce resultant force vectors that also affect the position and direction of movement of the cleaner. For a detailed understanding of a pool cleaner having a jet valve for producing a water jet to propel the cleaner in a forward and reverse direction, among other features of a pool cleaner suitable for implementing the steering assembly, the reader is directed to commonly assigned U.S. Pat. No. 7,900,308, issued Mar. 8, 2011, U.S. Pat. No. 7,827,643, issued Nov. 9, 2010, U.S. Pat. No. 7,165,284, issued Jan. 23, 2007, U.S. Pat. No. 6,742,613, issued Jun. 1, 2004 and U.S. Pat. No. 6,412,133, issued Jul. 2, 2002, the contents of which are incorporated herein by reference in their entirety.

With continuing reference to FIG. 1, the front wheels 18 are illustratively turned to the right to thereby cause the pool cleaner 10 to turn to the right while moving in a forward direction. Similarly, in FIG. 2, the front wheels 18 are illustratively turned to the left to thereby cause the cleaner 10 to turn to the left while moving in the forward direction. The wheels 18 are mounted on axles 20 and the wheels 18 are turned by a steering assembly 40, as shown in greater detail with respect to FIGS. 3 through 20.

Referring now to FIGS. 3 and 4, the steering assembly 40 as shown is mounted on the underside of the cleaner 10 to control the steering of the front wheels 18. For purposes of better understanding the invention, the front wheels are illustratively described as being the forward direction of movement of the cleaner, as well as being controlled by the steering assembly 40. However, those of ordinary skill in the art will appreciate that when the cleaner moves in the opposite direction, the wheels that are controlled by the steering assembly 40 function as the rear wheels and can also be used to control the directions(s) taken by the cleaner.

As shown in FIG. 3, the steering assembly 40 retains the axle 20 in a first position that causes the cleaner 10 to turn right in the forward direction, while as shown in FIG. 4, the steering assembly 40 is locked in a second position to cause the cleaner 10 to turn to the left while moving in the forward direction. Although the axle 20 is illustratively shown as a single axle extending transversely across the cleaner to facilitate mounting and rotation of the wheels, 18, a person of ordinary skill in the art will appreciate that each wheel 18 can be mounted and rotate about a separate and independent axle that is appropriately mounted to the sidewall of the base 14 or housing 12 by mechanical means.

The steering assembly 40 includes an axle locking-bar assembly 50 and a servomotor 42 having a rotatable shaft 44 that rotates the axle locking-bar assembly 50 to selectively engage with the opposing ends of the axle 20. In one embodiment, the servomotor 42 is a well-known commercially available servomechanism that includes negative feedback to control the degrees of rotation of the rotatable shaft 44. In one embodiment, the servomotor 42 rotates the shaft in a range of 5-10 degrees in either the counter-clockwise or clockwise directions (total range of 10-20 degrees), and preferably 7-8 degrees in either clockwise or counter-clockwise directions, although such degrees of rotation are not to be considered limiting. As is apparent, the range is directly related to the turning radius of the cleaner, and the greater the range the smaller, or tighter the turning radius will be.

The servomotor 42 is illustratively mounted to an interior side wall of the housing of the cleaner 10. For example, as shown in FIG. 3, the servomotor 42 is mounted to an interior wall or other supporting member that is positioned rearwardly with respect to the axle 20 of the front wheels 18. A first end of the rotatable shaft 44 is coupled to the servomotor 42 and the shaft 44 extends in the forward direction along the longitudinal axis L. Preferably, the rotatable shaft 44 extends along the central longitudinal axis of the cleaner 10. The axle locking-bar assembly 50 extends transversely to the rotatable shaft 44 and is fixedly attached to the shaft 44 by one or more fasteners, such as bolts, rivets, pins and the like. Various other mechanical engagement and mounting devices and members will be apparent and substitutions can be made by those of ordinary skill in the art.

During operation, the rotation of the shaft 44 by the servomotor 42 causes the respective opposing ends of the axle locking-bar assembly 50 to move (rotate) up and down with respect to the opposing ends of the wheel axle 20. Preferably, the distal end of the shaft 44 opposite the servomotor 42 is mounted through a bore 24 formed in the front portion of the housing of the cleaner 10. In this manner, both ends of the shaft 44 are securely mounted to the cleaner 10 to provide stability to the steering assembly 40.

Referring now to FIG. 5, the axle locking-bar assembly 50 includes a central mounting flange 52 that is mounted to the distal end of the shaft 44 by one or more fasteners 46 to thereby secure and prevent twisting of the axle locking-bar assembly 50 with respect to the shaft 44. Preferably, at least two fasteners 46 such as bolts, pins or rivets are provided through corresponding flange bores 54 to secure the central flange 52 of the axle locking-bar assembly 50 to the distal end of the shaft 44.

The axle locking-bar assembly 50 is preferably fabricated from a resilient flexible material such as LEXAN which is a polycarbonate polymer produced by SABIC Innovative Plastics of Pittsfield, Mass., USA. A person of ordinary skill in the art will appreciate that the axle locking-bar assembly 50 can be fabricated from other materials exhibiting flexible characteristics such as other polycarbonate polymers, fiberglass, nylon, carbon fibers or other flexible polymers, materials and/or metals. The various elements and constituent parts can be produced by molding, machining, cutting and assembly from the particular materials chosen based on their resistance to salt and other chemicals used in pool and tank maintenance.

The axle locking-bar assembly 50 includes a bowed cross-member 56 having opposing ends, each of which terminate at a flange guide 58 which extends upwardly with respect to the base plate 14 of the cleaner 10. Preferably the upright flange guide 58 are mounted to a reinforcing flange 64 formed at each opposing end of the bowed cross-member 56. The flange guides 58 extend upright with respect to the top surface of the resilient transverse member and can be angled at approximately plus or minus thirty degrees (+/−30° in either direction from the upright orthogonal axis "Y" (shown in FIG. 5) of the bowed cross-member 56. Preferably, the flange guides 58 are angled in a range of from 5° to 20° from the orthogonal axis Y.

Each upright flange guide 58 includes a top surface 60 and at least one axle receiving groove 62 formed therein. As illustratively shown in FIG. 5, the axle groove 62 is formed as a recess or cutout that is configured to receive a portion of the outer surface of the axle 20 and, in one embodiment, the axle groove 62 is positioned centrally along the top surface 60 of the flange guide 58. Although the axle groove 62 is illustratively shown as an arcuate-shaped cutout, a person of ordinary skill in the art will appreciate that the groove 62 can have any other shape that conforms to and/or will receive and retain the outer surface of the axle 20 which interfaces with the guide 58. The top surface 60 of each upright flange 58 slopes down towards the groove 62, such as that the height proximate the outer edges of the flange 58 is greater than the height of the top surface proximately axle groove 62. In this manner, the top surface of the guide 58 acts as a wedge to guide, i.e., slide the axle 20 along the top surface 60 towards the axle groove 62 and retain the end of the axle 20 at the central position therein.

Figure 6:
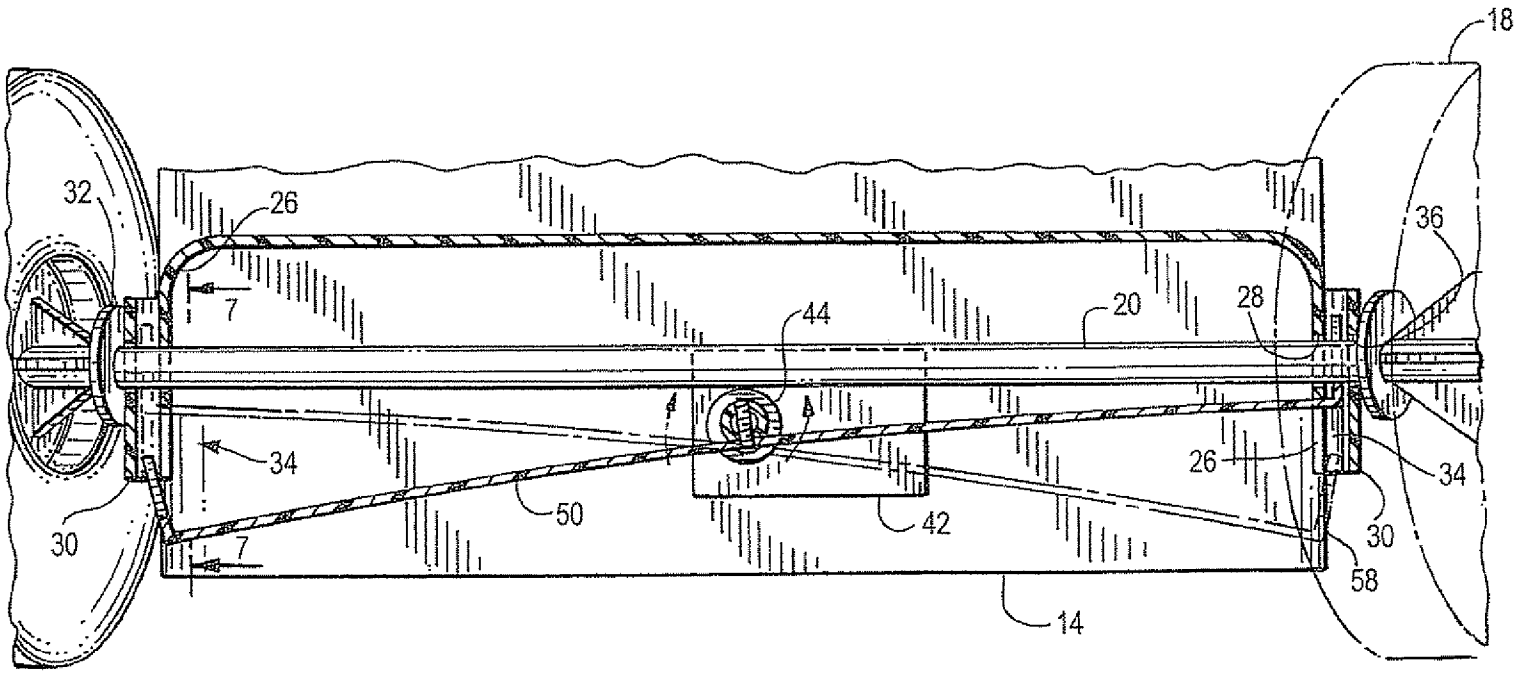
FIG. 6 is a front elevation view, partly in cross-section taken along lines 6-6 of FIG. 3, illustrating the bowed cross-member of the steering assembly engaged with one end of the axle proximate the right forward directional wheel and disengaged with the opposite end of the axle proximate the left forward directional wheel to thereby turn the cleaner to the right.

Referring to FIG. 6, when the servomotor 42 rotates the shaft 44, e.g., counter-clockwise with respect to the front view of the cleaner 10, the axle locking-bar assembly 50 is also rotated such that the upright flange guide 58 proximate the left wheel 18 moves to engage the left end of the axle 20. Concurrently, the opposing right side upright flange guide moves down and away from the right end of the axle 20. Rotating the shaft 44 in the clockwise direction has the opposite effect such that the right side flange guide moves up to engage the right axle end while the left side flange guide moves down to disengage from the left end of the axle. Accordingly, rotating the axle locking-bar assembly 50 controls the engagement and disengagement of the opposing upright flange guides 58 with respect to the opposing ends of the axle 20. A rotational movement produces a movement in a remote vertical plane.

Referring now to FIGS. 6 through 9, each end of the axle 20 is positioned relative to the housing 12 in an elongated inner axle stabilizing slot 28 formed in the sidewall 26 of the cleaner. In a preferred embodiment, an outer axle stabilizing wall 30 is formed adjacently over the external surface of the base plate sidewall 26 such that a receiving slot 34 is formed therebetween. The outer axle stabilizing wall 30 includes an elongated outer axle stabilizing slot 36 which is adjacent and aligned with the inner axle stabilizing slot 28. The end of the axle 20 passes through both slots 28 and 36. Preferably, the elongated outer slot 36 is slightly longer than the elongated inner slot 28 to accommodate angular movement of the axle 20 within the slots 28 and 36. Further, the receiving slot 34 is configured to receive the upright flange guide 58.

Accordingly, as the upright flange guide 58 is rotated up towards the end of the axle 20, the top surface 60 moves up through the receiving slot 34 formed between the outer surface of the sidewall 26 and the inner surface of the outer axle stabilizing wall 30. Preferably, the combination of the height of the upright flange guide and the limited rotation of the bowed cross-member 56 prevent the upright flange guide 58 from completely exiting the receiving slot 34 when the axle locking-bar assembly 50 is rotated in a direction that disengages the upright flange 58 from the axle 20. In this manner, base sidewall 26 and axle stabilizing wall 30 consistently guide the upright flange 58 when engaging and disengaging from the axle 20, as well as protect the upward flange guide 58 from twisting and bending, or otherwise being damaged by debris during operation.

Figure 7:
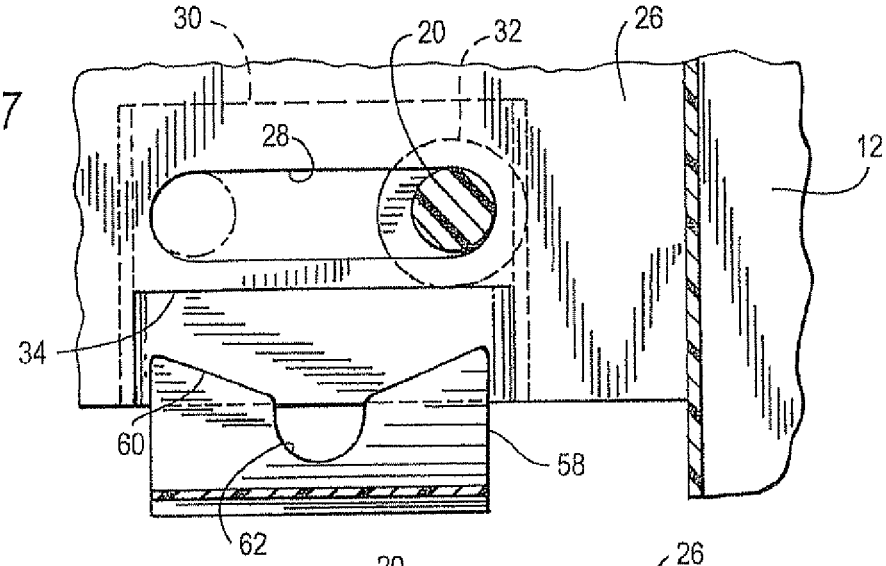
FIGS. 7-9 depict a series of side elevation views, partly in cross-section, illustrating an upright flange guide of the bowed cross-member of FIG. 5 while disengaging and engaging an end of the axle that is mounted in a slotted channel proximate a corresponding forward directional wheel.
Figure 8:
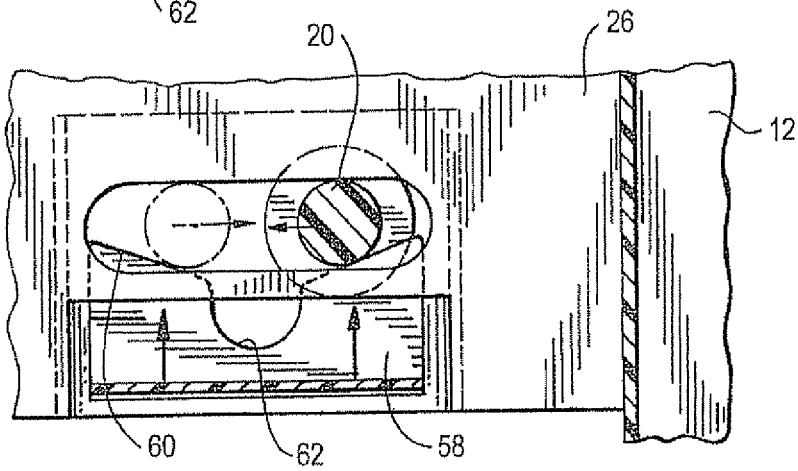
Figure 9:
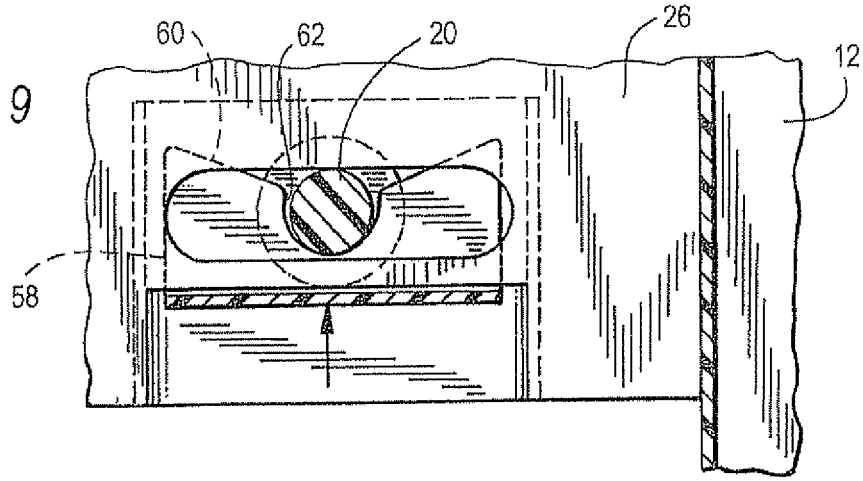

Referring to FIGS. 7 through 9, movement of the upright flange guide 58 is shown with respect to a corresponding end of the axle 20 while illustratively rotating the axle locking-bar assembly 50 counter-clockwise. Referring to FIG. 7, the axle slot 28 is shown formed in the base sidewall 26 of the cleaner 10. The axle slot 28 is elongated and extends substantially parallel to the base plate 14 of the cleaner 10. The slot 28 is configured to receive the end of the axle and allow the axle end 20 to move in either the forward or backward direction along the longitudinal axis L of the cleaner 10 with very little up or down movement, or play, within the slot 28. As shown in FIG. 7, the upright flange guide 58 is positioned below and away from the end of the axle 20 such that the top surface 60 of the flange is disengaged from the axle 20, yet still remains positioned in the receiving slot 34 formed between the base sidewall 26 and axle stabilizing wall 30. As shown in FIG. 7, the axle 20 is illustratively positioned on the right side, i.e., rear portion of the slot 28.

Referring to FIG. 8, the upright flange 58 is illustratively shown rotated upwardly towards the axle 20. As the sloped top surface 60 interfaces with the lower outer circumference of the axle 20, the axle 20 is guided along the top surface and moves forward towards the middle of the slot 28. In this manner, the rotational force of the shaft produces an upward force on the upright flange guide 58 which is sufficient to slide the axle 20 in the forward direction along the top surface 60 of the guide 58 and the slot 28.

As shown in FIG. 9, the shaft 44 has rotated a sufficient amount such that the upright flange guide 58 has forced the axle 20 to the center portion of the slot 28 and the axle groove 62 substantially circumscribes the axle 20 and locks the axle end at the central location of the slot 28. In addition, the servomotor 42 locks the shaft 44 in its final rotated position such that the flange guide 58 will not move down. Thus, the axle 20 is locked in the central position as illustratively shown in FIG. 9. The locking operation of the shaft 44 by the servomotor 42 is performed by a controller 2100, the operation of which is discussed in further detail below with respect to FIG. 21. A person of ordinary skill in the art will appreciate that the locking position of the axle 20 is dependent on the positioning of the axle groove 62 formed in the top surface 60 of the upright flange guide 58. Accordingly, the central positioning of the axle groove 62 is not limiting as other embodiments of the upright flange guide 58 contemplate other positions of the axle groove 62, as illustratively shown and described below with respect to FIGS. 14-16.

Figure 10:
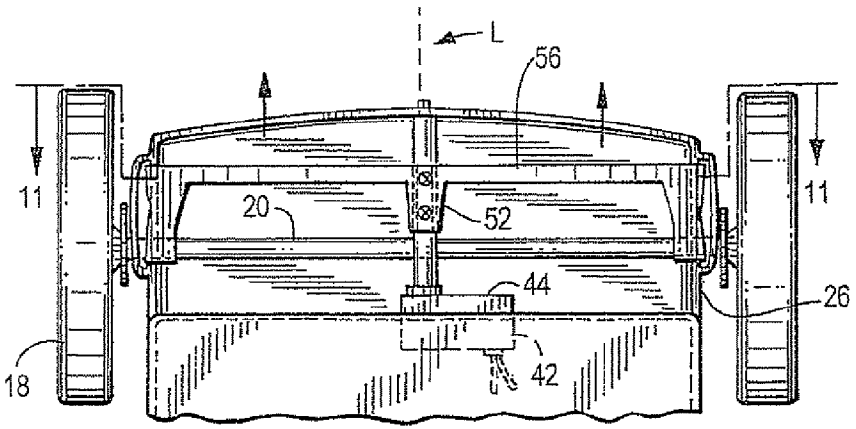
FIG. 10 is a bottom, plan, sectional view of the pool cleaner of FIG. 1 illustrating the steering assembly disengaged from the axle of the forward directional wheels to enable the cleaner to move along a linear path.
Figure 11:
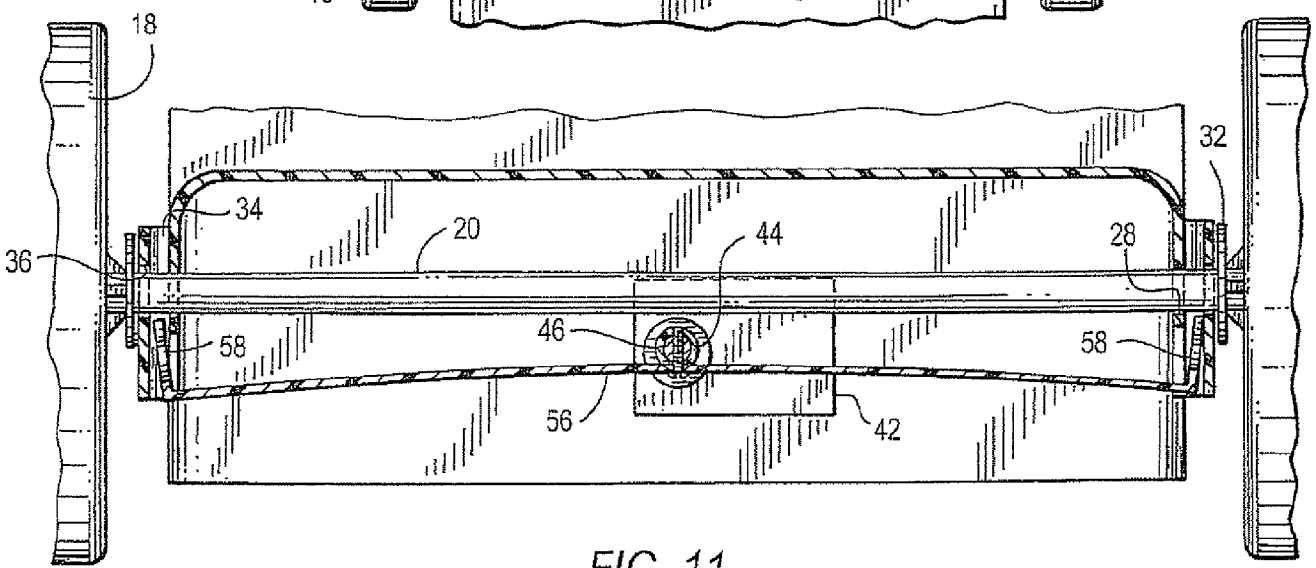
FIG. 11 is a front elevation view, partly in cross-section, of the bowed cross-member of the steering assembly of FIG. 10 disengaged at both ends of the axle to thereby enable the cleaner of FIG. 1 to move linearly in the forward direction.

Referring now to FIGS. 10 and 11, the pool cleaner 10 is illustratively shown moving over the pool surface in a straight line direction corresponding to the longitudinal axis L. The bowed cross-member 56 is arced down with respect to the central flange 52. In this manner, when the servomotor 42 rotates the shaft 44 to a neutral position such that the bowed cross-member 56 is substantially level or parallel to the base plate 14, the two opposing upright flanges 58 are slidably disengaged from the axle ends 20, yet are still slidably positioned between and protected by the base sidewall 26 and axle stabilizing wall 30. Further, when the axle locking-bar assembly 50 is maintained in the neutral position by the servomotor 42 while the cleaner 10 is moving in a straight line direction corresponding to the longitudinal axis L, the opposing axle ends 20 will slide rearwardly to the rearward edge of the inner axle stabilizing slot 28 and outer axle stabilizing slot 36, as illustratively shown in FIG. 7.

Accordingly, the rotation of the bowed cross-member 56 in either a clockwise or counter-clockwise direction controls the engagement and disengagement of the upright flange guide 58 on either end of the axle 20. Specifically, the upright flange guides 58 can be used to lock one end of the axle 20 at a central location in the slot 28, while the opposing axle end is free to slide rearwardly in the slot 28 as the cleaner moves forward to thereby enable the cleaner to turn in the direction of the free end of the axle 20. That is, when one axle (e.g., the left axle) is engaged by the corresponding upright flange guide 58, the opposing axle is disengaged from its corresponding guide 58 and will slide to the lateral edge of the slot 28, as the cleaner is propelled forward along its longitudinal axis.

For example, if the left axle end is locked into position by the upright flange guide 58 and the right axle end is free to slide back in the slot 28, the left wheel will be in the forward position with respect to the right wheel. Accordingly, the cleaner 10 will steer to the right when moving in a forward direction. Similarly, if the right end of the axle 20 is locked into a central position of the slot 28 by the right upright flange guide 58 and the left axle end is free to slide rearwardly in the slot 28, the right wheel 18 will be positioned forward of the left wheel, and the cleaner 10 will steer to the left when moving in a forward direction.

A person of ordinary skill in the art will appreciate that if the cleaner moves in the opposite, i.e., reverse direction, the free end of the axle will move to the opposite end of the respective slot pairs 28 and 36, and the steering direction will be reversed. For example, if the left front axle is locked by the upright flange guide 58 and the right front axle remains free to slide in the slot pair 28 and 36, when the cleaner 10 reverses direction, the free end of the axle 20 will slide back such that the steering is controlled by what now will be the rear wheels. As such, the locked positioned left wheel 18 will be positioned forward of the free right wheel, and the cleaner 10 will steer to the right when moving in a forward direction.

Referring to FIGS. 12 and 13, a second and third embodiment of the steering assembly 40 is illustratively shown. In particular, each upright flange guide 58 is controlled and positioned in place with respect to axle ends 20 via a flange rotating means 80, such as an actuator or a solenoid. For example, referring to FIG. 12, the lower portion of each upright flange guide 58 includes a projecting member such as an elongated shaft 70 that extends longitudinally along the longitudinal axis L. The upright flange guide 58 is attached to a first end of the shaft 70 and the opposing second end of the shaft 70 is pivotally coupled to an actuator 89. The shaft 70 is connected at a pivot point 76 to the sidewall 26 of the housing 12 positioned between the opposing first and second ends of the shaft 70. The shaft 70 can be pivotally connected at pivot point 76 with a fastener, such as a pin, bolt, rivet, and the like. During operation, the actuator 89 rotates of the upright flange guide 58 about the pivot point 76 to disengage and/or re-engage the top surface 60 of the upright flange guide 58 with the axle end 20.

As shown in the second embodiment of FIG. 12, the actuator 89 is a solenoid or other piston-like device having a slidable rod 88 that includes a free end that is pivotally attached to the second end of the shaft 70. In one embodiment, a fastener extends through a slot 78 formed in second end of the shaft 70 and the free end of the rod 88. The slot 78 enables the upright flange guide 58 to rotate about the fixed pivot point 76. The actuator 89 is also mounted to the sidewall 26 of the housing such that when the slidable rod 88 is fully extended, the upright flange guide 58 rotates about the pivot point 76 and engages the end of the axle 20, as discussed above with respect with the upright flange guide shown in FIGS. 7 through 9. Similarly, when the slidable rod 88 is retracted, the distal second end of the shaft moves upwardly and the upright flange guide 58 moves down to disengage the guide from the end of the axle 20. A person of ordinary skill in the art will appreciate that other flange rotating devices can be utilized to engage or disengage the upright flange guide 58 and the end of the axle 20. Accordingly, each actuator 89 can independently control the positioning of the respective end of the axle 20 along each slot 28 formed at each side of the housing 12 of the cleaner 10.

For example, referring to the third embodiment of the steering assembly shown in FIG. 13, the distal end of the shaft 70 is illustratively coupled to a reversible servomotor 91, which upon activation, rotates the upright flange guide 58 upward and downward to engage and disengage the respective end of the axle 20 in a similar manner as described above.

Figure 14:
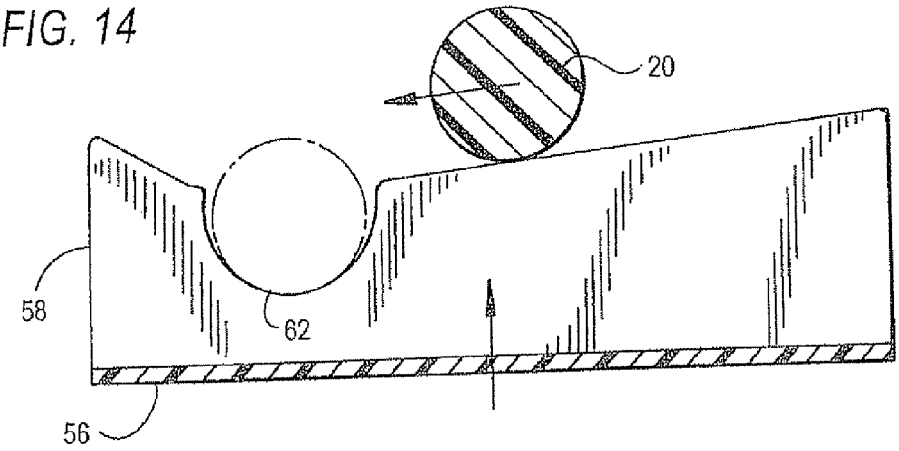
FIG. 14 is a side elevation view, partly in cross-section, of a second embodiment of the upright flange guide for locking an end of a wheel axle to control steering of the cleaner of FIG. 1.
Figure 15:
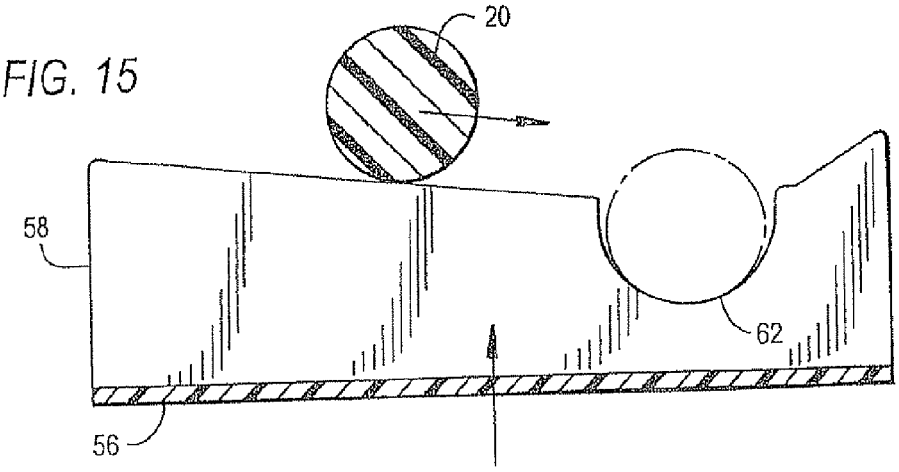
FIG. 15 is a side elevation view, partly in cross-section, of a third embodiment of the upright flange guide for locking an end of a wheel axle to control steering of the cleaner of FIG. 1.
Figure 16:
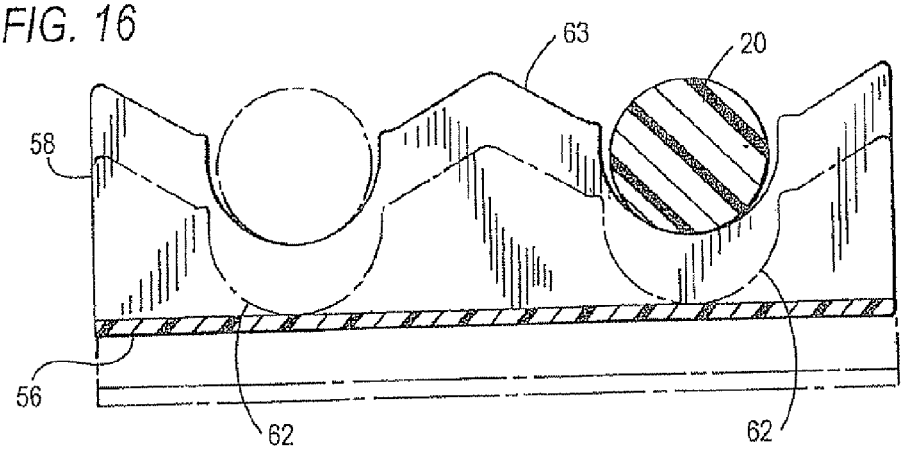
FIG. 16 is a side elevation view, partly in cross-section, of a fourth embodiment of the upright flange guide for locking an end of a wheel axle to control steering of the cleaner of FIG. 1.

Referring now to FIGS. 14 through 16, various illustrative embodiments of upright flange guides 58 are shown. Referring back to FIGS. 7-9, the axle groove 62 is shown centrally located along the top surface 60 of the flange guide 58. In the alternative embodiments shown in FIGS. 14-16, one or more of the axle grooves 62 are formed at different positions along the top surface 60 to produce a different turning ratio for the cleaner 10. For example, referring to FIG. 14, the axle groove 62 is positioned proximate the forward leading edge of the upright flange guide 58, while in FIG. 15, the axle groove 62 is positioned proximate the trailing rear end of the upright flange guide 58. Positioning the axle groove 62 towards the leading edge of the upright flange guide 58 will produce a tighter or small turning radius, while positioning the axle groove 62 proximate the rear edge of the upright flange guide 58 will produce a greater turning ratio.

Referring to FIG. 16, the upright flange guide 58 includes multiple axle grooves 62 that can be used to control the turning radius of the cleaner 10. As illustratively shown in FIG. 16, a first axle groove is positioned near the leading edge and a second axle groove is positioned near the opposing trailing edge of the upright flange guide 58. A triangular shaped wedge 63 is formed between the leading and trailing grooves 62 to assists in guiding the axle 20 to one of the grooves proximate the leading edge or the trailing edge. The embodiment shown in FIG. 16 provides multiple turning patterns to be selected by the user. For example, a tight right turn can be made by capturing the left axle end 20 in the forward or leading edge groove 62 and also capturing the right axle end 20 in the trailing edge axle groove of the upright flange guide 58. The multiple axle grooves 62 formed in the flange guides 58 enables varying turning radii to be used in the cleaning pattern of the cleaner. The upright flange guide 58 of FIG. 16 is suitable for use with any of the steering embodiments using the upright flange 58 described herein.

Figure 17:
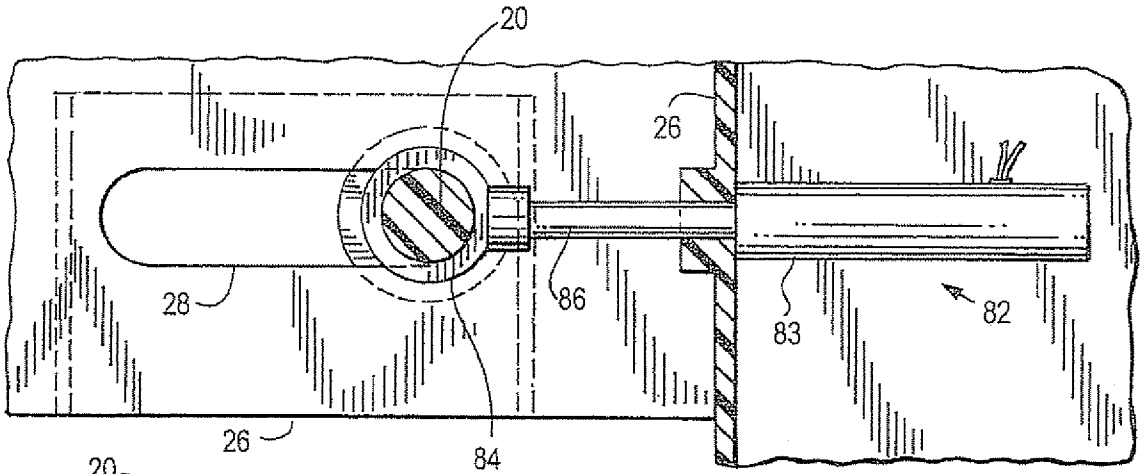
FIGS. 17-18 are side elevation views, partly in cross-section, illustrating a fourth embodiment of the steering assembly illustrating a piston for positioning an end of a wheel axle to control steering of the cleaner of FIG. 1.
Figure 18:
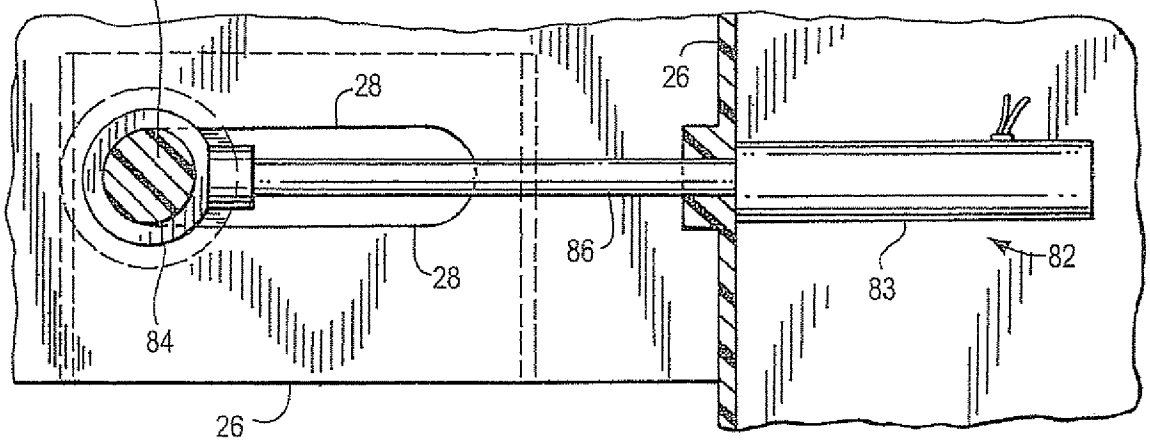

Referring to FIGS. 17 and 18, a fourth embodiment of the steering assembly 40 is illustratively shown. In this embodiment, each end of the axle 20 is controlled and positioned within the corresponding slot 28 of the sidewall 26 of the base 14 by an actuator 82. In a preferred embodiment, the actuator 82 includes a solenoid 83, servomotor or other appropriate device having an extendible and retractable shaft 86 which slidably extends outward and retracts inward parallel to the longitudinal axis L of the cleaner. The free end of the shaft 86 includes a ring or clamp 84 that circumscribes at least a portion of the axle 20 while permitting the axle to freely rotate. As shown in FIG. 17, when the shaft 20 is in the fully retracted position, the ring 84 retains the end of the axle 20 rearwardly towards the trailing edge of the elongated slot 28 formed in the base sidewall 26. Referring to FIG. 18, when the shaft 86 is in its fully extended position, the ring 84 pushes the end of the axle forward to the leading edge of the elongated slot 28 formed in the sidewall 26 of the base 14. Accordingly, each actuator 82 can independently control the positioning of the respective end of the axle 20 along each slot 28 formed at each side of the housing 12 of the cleaner 10.

For example, if the cleaning program includes commands for a right turn having a tight turning radius, the left actuator 82 will fully extend the shaft 86 such that the end of the axle 20 will be positioned at the leading edge of the elongated slot 28, while the right side actuator 82 will be fully retracted such that the axle end 20 will be pulled rearwardly towards the trailing edge of the elongated slot 28. As will be appreciated by a person of ordinary skill in the art, the direction of a turn and the turning radius can be controlled and varied by adjusting the positioning of the right and left axle ends within the respective slots 28 formed along the sidewall 26 of the housing 12. For example, a controller 2100, such as described below with respect to FIG. 21, can be programmed to control the length each shaft 86 extends and retracts to thereby control the turning radius of the cleaner during the cleaning operation.

Figure 21:
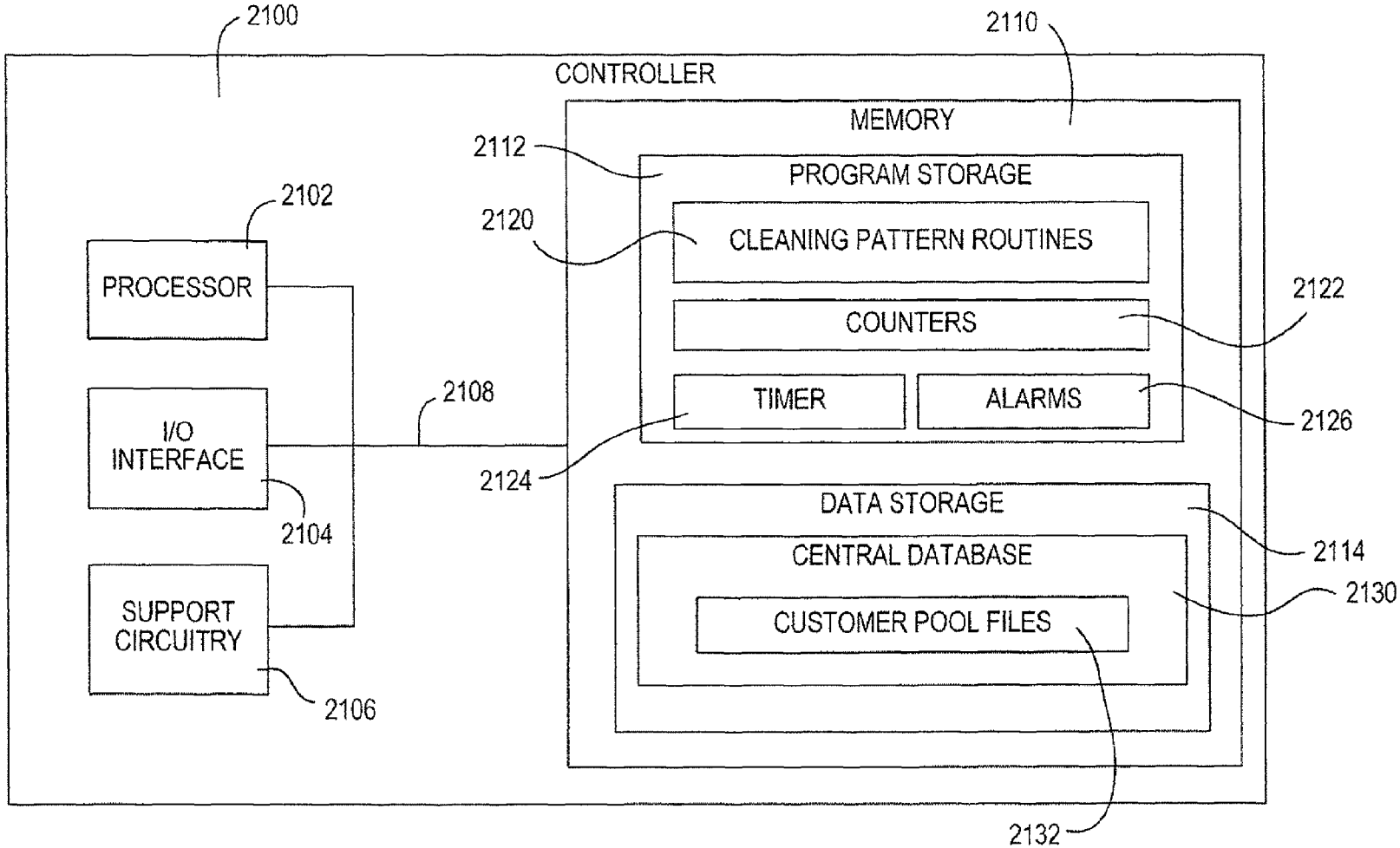
FIG. 21 is a schematic block diagram of a controller suitable for controlling steering operations of the pool cleaner of FIG. 1.

Referring now to FIG. 21, a schematic block diagram of a controller 2100 suitable for controlling steering operations of the pool cleaner 10 is illustratively shown. The controller 2100 includes multitasking, real-time software that can concurrently handle hundreds of thousands of queries and updates.

The controller 2100 can be any computer device such as a microcontroller. While the controller 2100 is shown for illustration purposes as a single computer unit, the system can comprise a group of computer devices which can be scaled depending on the processing load and database size.

Specifically, the controller 2100 comprises at least one processor 2102, as well as memory 2110 for storing various control programs 2112. The processor 2102 is preferably a microprocessor or can be any conventional central processing unit (CPU), such as one or more INTEL® processors. The memory 2110 can comprise volatile memory (e.g., DRAM), non-volatile memory (e.g., disk drives) and/or a combination thereof. The processor 2102 cooperates with support circuitry 2106, such as power supplies, clock circuits, cache memory, among other conventional support circuitry, to assist in executing software routines (e.g., method 300) stored in the memory 2110. The one or more processors 2102, memory 2110 and support circuitry 2106 are all commonly connected to each other through one or more bus and/or communication mediums (e.g., cabling) 2108.

The controller 2100 also comprises input/output (I/O) circuitry 2104 that forms an interface between various functional elements communicating with the controller 2100. For example, the controller 2100 is connected to a communication link through an I/O interface 2104, which receives information from and sends information (e.g., electrical signals) over a communication link (e.g., an electrical conductor) to the servomotor 42.

The memory 2110 includes program storage 2112 and data storage 2114. The program storage 2112 stores the cleaning pattern routines 2120, an operating system (not shown), counters 2122, timers 2124, alarms 2126 and other application programs. In one embodiment, the counters 2122 can be used to count a number of turns being made by the cleaner, and the timers 2124 can include a clock to determine time that has lapsed since a previous turn was made. The alarm 2126 can be used to alert the user of a failure to turn the cleaner after a predetermined count time has lapsed. The data storage 2114 can be an internal or separate storage device, such as one or more flash memory devices, disk drive arrays or other memory devices which can be accessed via the I/O interface 2104 to read/write data. The data storage 2114 can include a central database 2130 which includes customer pool files 2132, as well as other data storage files. The customer pool files 2132 can include preprogrammed files based on predetermined dimensions of the customer's pool. Alternatively, the customer pool files 2132 can include files based on metrics determined by the cleaner 10 as it cleans the pool.

The central database 2130 is preferably provided internally to the controller 2100, although an external database is also comprehended by the present invention. Any of the software program modules in the program storage 2112 and data from the data storage 2114 are transferred to specific memory locations (e.g., RAM) as needed for execution by the processor 2102.

As such, it is to be understood that some of the cleaning process steps described as software processes can be implemented within hardware, for example, as circuitry that cooperates with the processor 2102 to perform various steps. It is noted that the operating system (not shown) and optionally various application programs (not shown) are stored in the memory 2110 to run specific tasks and enable user interaction, i.e., customize the operation of the pool cleaner with respect to the user's pool.

For example, the cleaning pattern routines 2120 can include random or predetermined cleaning routes that are calculated based on the configuration and dimensions of the pool to be cleaned. The turning of the cleaner can be random or based on timers or counters 2124 that trigger a turn after a predetermined time or count has elapsed. Alternatively, the turning of the cleaner can be based on signals received from external sensors, such as a motion, proximity and/or GPS sensor sending a signal to the controller 2100 via the I/O interface 2104 indicating that a sidewall of the pool has been reached or a ladder or other obstruction is in the path of the cleaner 10. The cleaning patterns are well-known in the art and do not form a part of the invention. However, the steering assembly 40 responds to signal commands sent by the controller 2100 in accordance with the cleaning pattern routines and customer pool files 2132 stored therein. For example, the cleaning pattern routine 2120 can include a series of right and left turns that are sequenced based on time or turn counts to efficiently clean the bottom and sidewall surfaces of the pool or tank, as well as prevent undesirable coiling of the floating power cable. The signal commands are provided in the form of electrical signals sent to the servomotor 42, or steering actuators 80, 82, which reverse the polarity of the servomotor 42 to thereby change the direction of rotation of the shaft 44. The engagement and disengagement of the steering assembly with respect to the ends of the wheel axles are described in detail above with respect to FIGS. 1-18.

Figure 19:
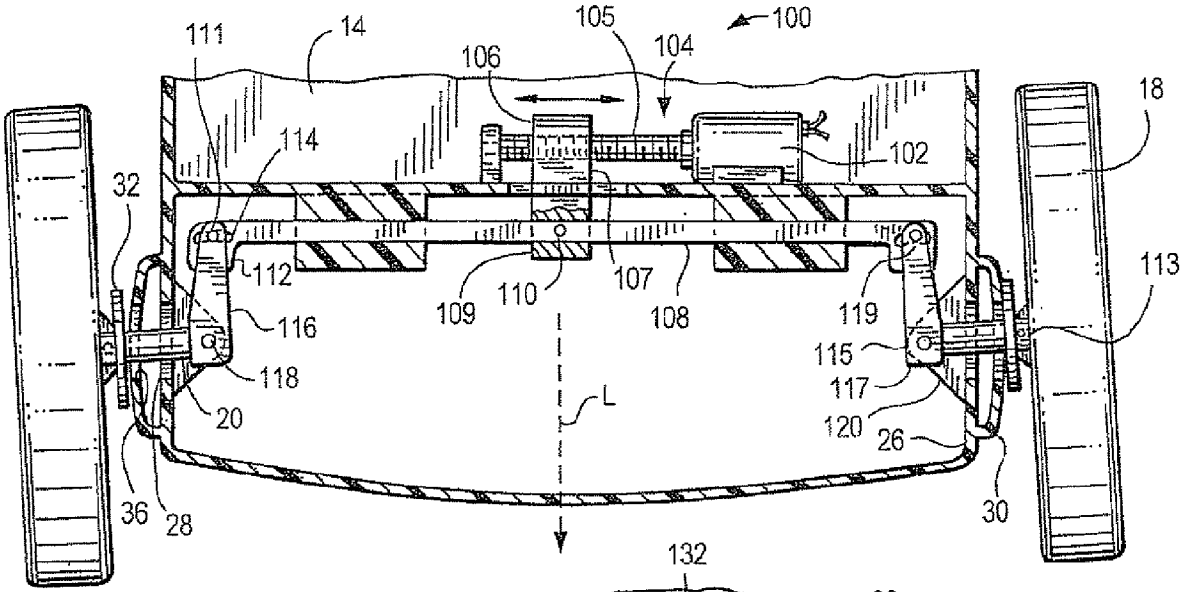
FIG. 19 is a top plan view, partly in cross-section, illustrating a fifth embodiment of the steering assembly utilizing a worm gear and steering control link system for controlling steering of the pool cleaner of FIG. 1.

Referring now to FIG. 19, a partial cross-sectional view of a fifth embodiment of the steering assembly 100 is illustratively shown. The cleaner 10 includes a pair of front wheels 18 mounted to the opposing sidewalls 26 of the base 14 using independent axles 20. Each of axles 20 is substantially normal to the longitudinal axis L. Each axle 20 has an outer end 113 that is mounted to a wheel 18 and an inner end 115 that extends through the elongated slot 36 formed in the outer axle stabilizing wall 30 and the adjacent inner slot 28 formed in the base sidewall 26. The slot pairs 28 and 36 are formed in the sidewall of the cleaner and extend in a direction along the longitudinal axis as previously described above with respect to FIGS. 1-11. The opposing inner ends 115 of the axles 20 are not directly connected to each other. Rather, the each axle is separate and controlled by the steering assembly 100.

Each inner end 115 of the axle 20 is pivotally attached to a mounting bracket 120 with a fastener 118, such as a bolt or pin. As shown in FIG. 19, the inner end 115 of each axle is stationary, but can rotate in the longitudinal direction such that the opposing outer end 113 can slidably move along the length of the respective pair of slots 28 and 36 to angle, i.e., turn the wheel 18 to the right or left, depending on the displacement of a steering control link 108 as described in further detail below.

The steering assembly 100 includes a steering control link 108 that extends transversely between the opposing inner ends 115 of the axles 20. The steering control link 108 includes opposing ends 112, each of which is coupled to a respective inner end 115 of an axle 20 via a steering arm 116. In one embodiment, each end 112 of the steering control link 108 includes an arcuate slot 114 extending substantially normal to the longitudinal axis L. In an embodiment, each of the steering arms 116 is generally elongated and has a first end 117 pivotally coupled to a respective inner end 115 of an axle 20 and corresponding mounting plate 120 via the fastener 118. The opposing second end 119 of each steering arm 116 includes a bore, and is pivotally coupled to a respective end 112 of the steering control link 108 via a fastener 111, such as a bolt, pin or rivet which extends through the slot 114 and the bore formed in the second end 119 of the steering arm 116. In this manner, one end of the steering anus 116 is pivotally coupled to an inner end 115 of the pair of axles 20, and the other end of the steering arms are coupled together via the steering control link 108. As such, the pair of wheels 18 can be turned in the same direction, since they are physically linked to each other.

The steering control link 108 is moved laterally with respect to the longitudinal axis L by a reversible electric motor 102 having a worm drive 104. The worm drive 104 includes a stationary screw or bolt 105 and a following block 106 that is threaded over the screw 105 at a first end 107, and which is fastened at a second end 109 to the control link 108 via a fastener 110, such as a bolt, pin, screw, rivet, and the like. The electric motor 102 can be mounted to an interior wall of the cleaner 10 and rotates the screw 105 such that the following block 106 moves to the left or the right, as the worm drive 104 is turned clockwise or counter-clockwise by the reversible motor 102. For example, if cleaner 10 is moving forward and the motor 102 turns the screw counter-clockwise, the following block moves along the threaded screw 105 towards the right sidewall, which in turn moves the control link 108 towards the right sidewall. The fastener 111 at the second end 119 of the steering arm 116 moves to the trailing edge of the arcuate slot 114, which in turn pushes the second end 119 of the steering arm 116 to pivot about the stationary fastener 118 at the first end 117 of the steering arm and the inner end 115 of the axle 20. Contemporaneously, the second end 119 of the left steering arm 116 is pulled to the right and pivots about the other stationary fastener 118 at the first end 117 of the steering arm and the inner end 115 of the axle 20, thereby turning both wheels 18 to the left relative to the longitudinal axis L. In a similar manner, turning the screw 105 clockwise turns both wheels 18 to the right. A person of ordinary skill in the art will appreciate that the turning radius of the cleaner is defined in part by the length of the adjacent pairs of slots 28 and 36 formed in the sidewalls of the cleaner, as well as the lateral displacement of the steering control link 108 from a centrally neutral position along the central longitudinal axis of the cleaner. Further, the electric motor 102 is responsive to signal commands from the controller 2100 described above with respect to FIG. 21. In particular, electrical signals are sent to the motor to turn it on and off, as well as to control the polarity to reverse direction of the rotation of the screw 105 in either the clockwise or counter-clockwise direction.

Figure 20:
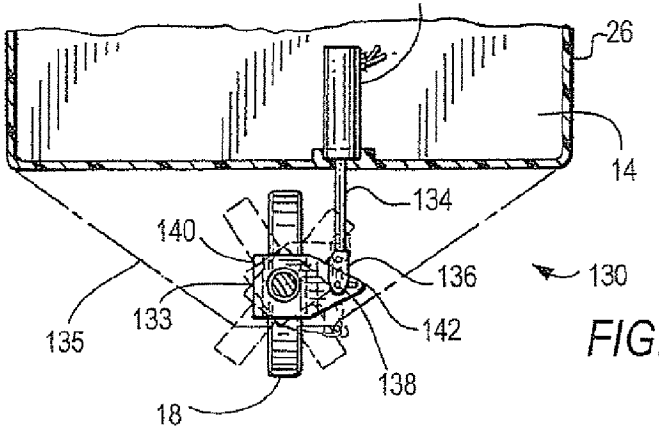
FIG. 20 is a top plan view, partly in cross-section, illustrating a sixth embodiment of the steering assembly utilizing a servomotor for controlling angular rotation of a single rotatable wheel used for steering a pool cleaner.

Referring to FIG. 20, a partial cross-sectional view of a sixth embodiment of the steering assembly 130 is illustratively shown. The cleaner 10 illustratively includes a single wheel 18 having a central axle (not shown) which is mounted to a U-shaped flange or yoke 140 that includes a shaft 133 extending upright from the middle portion of the U-shaped yoke 140. The upright shaft 133 is positioned over the wheel tread and the opposing legs of the yoke 140 are positioned adjacent to the opposing sides of the wheel 18. The wheel 18 rotates about the axle in the horizontal X plane, and the wheel 18 and yoke 140 rotate about the shaft 133 in the vertical Y plane. The shaft 133 of the wheel 18 extends from the top portion of the yoke and is mounted to a mounting plate 135 (shown in phantom in FIG. 20) parallel the central longitudinal axis L proximate the front or rear portions of the housing 12. Alternatively, a pair of wheels can be mounted to the base 14 or mounting plate 135 proximate the opposing sidewalls 26 of the housing 12.

In either embodiment, the yoke 140 and wheel 18 collectively rotate about the shaft 133. The steering assembly 130 includes a servomotor 132 having a rod 134 that selectively extends and retracts in response to command signals sent by the controller 2100 described above. The distal free end 136 of the rod 134 is pivotally connected to the yoke 140 such that the retraction or extension of the rod 134 causes the yoke 140 and the wheel assembly to collectively turn counter-clockwise or clockwise about the shaft 133. As illustratively shown in FIG. 20, the top of the yoke 140 includes a triangular shaped flange extending outward and includes an elongated slot 142 through which a fastener, such as a pin, bolt or rivet pivotally couples the free end 136 of the rod 134 to the yoke 140. The elongated slot 142 is configured to enable the yoke 140 to rotate while the rod 134 is retracted or extended. Accordingly, the steering assembly 130 is responsive to control signals provided thereto during execution of the cleaning pattern routine 2120, and can include numerous right and left turns that are sequenced to efficiently clean the bottom and sidewall surfaces of the pool or tank, as well as prevent undesirable coiling of the floating power cable.

The steering assemblies and their methods of operation comprehended by the present invention provide numerous advantages over the prior art. Illustratively, the advantages over the prior art include, but are not limited to, an improved automated or robotic pool and tank cleaning apparatus that incorporates reliable mechanisms and methods of steering the pool cleaner with respect to the longitudinal axis of the apparatus. Additionally, the present invention provides simple and reliable apparatus and methods for adjustably controlling the direction of the pool cleaner to attain proper scanning patterns in order to clean the entire submerged bottom and side wall surfaces of the pool, regardless of the configuration of the pool and the presence of apparent obstacles. The positioning of one or more of the wheels or other support means of the cleaner can be varied in order to vary the directional movement and scanning patterns of the apparatus with respect to the bottom surface of the pool or tank being cleaned. Further, the automatic steering of the cleaner helps assure the free and unimpaired movement of the pool cleaner in its prescribed or random scanning of the surfaces to be cleaned, and without interference from the buoyant electrical power cable that is attached to the cleaner housing and floats on the surface of the pool. Moreover, the automatic steering assembly helps prevent the prolonged immobilization of the cleaner by an obstacle and enables it to resume its predetermined scanning pattern. Accordingly, the present invention enables the pool cleaner to operate in a more cost-effective, reliable and simplified manner than is available through the practices and teachings of the prior art.

While the foregoing is directed to embodiments of the present invention, other and further embodiments of the invention can be devised by those of ordinary skill in the art based on this description without departing from the basic scope of the invention, which is determined by the claims that follow.

The invention claimed is:

1. A self-propelled robotic cleaning apparatus for cleaning a submerged surface of a pool or tank comprising:

a housing having a front portion, an opposing rear portion and adjoining side portions defining the periphery of the apparatus, and a base with at least one water inlet;

a water pump configured to draw water and debris from the pool or tank through the at least one water inlet for filtering and discharging filtered water through at least one water-discharge outlet;

rotationally-mounted supports coupled proximate the front and rear portions of the housing, said rotationally-mounted supports including a pair of rotationally-mounted supports each of which is coupled to an opposing end of an axle, the opposing axle ends being slidable along the housing in a forward and rearward direction relative to the directional path of the cleaner;

a controller having a memory for storing a cleaning program and a processor electrically coupled to the memory, the cleaning program being executable by the processor and operable to automatically control positioning of each end of the axle relative to the housing to steer the cleaning apparatus while the cleaner is moving in a forward or reverse direction; and a steering assembly for directing movement of the opposing axle ends in response to control signals received from the controller, the steering assembly comprising an upright flange guide positioned proximate to each of the respective opposing axle ends and having a top surface that selectively engages with and disengages from the corresponding axle end.

2. The apparatus of claim 1, wherein each of said upright flange guides includes an inclined top surface portion.

3. The apparatus of claim 1, wherein each of said upright flange guides includes at least one axle groove formed in the top surface that is sized to circumscribe at least a portion of the axle end and secure the axle end in a selected position along the directional path.

4. The apparatus of claim 3, wherein the at least one axle groove is a single groove positioned intermediate the ends of the top surface.

5. The apparatus of claim 3, wherein the at least one axle groove is a plurality of axle grooves formed in spaced apart relation in the top surface.

6. The apparatus of claim 3, wherein the top surface of each upright flange guide slopes down towards the at least one axle groove.

7. The apparatus of claim 1, wherein each of said upright flange guides is coupled to a cross-member which extends transversely to the longitudinal axis of the cleaner, said transverse cross-member being attached to a rotatable shaft that is mounted on the housing.

8. The apparatus of claim 7, wherein rotation of the shaft is controlled by the controller.

9. The apparatus of claim 7, wherein the shaft is rotatable in a range of from five to fifteen degrees.

10. The apparatus of claim 7, wherein, each one of the upright flange guides is coupled to an opposing end of the cross-member which extends transversely to the longitudinal axis of the cleaner, said transverse cross-member being mounted at its center to the rotatable shaft.

11. The apparatus of claim 7, wherein the cross-member is flexible and is bowed downward from the middle of the rotatable shaft.

12. The apparatus of claim 1, wherein each opposing end of an axle extends through a corresponding elongated slot formed in the side portions of the housing, said slots being orientated substantially parallel to the surface being cleaned and sized to enable forward and rearward directional movement of the axle end therein.

13. The apparatus of claim 12, wherein each elongated slot is formed in an inner sidewall of the side portion of the housing, said apparatus further comprising an outer axle stabilizing sidewall mounted over and adjacent to the inner sidewall to form a receiving channel therebetween, said outer stabilizing sidewall including an outer slot configured to align with the elongated slot and also receive the opposing end of the axle there-through, and wherein the receiving channel is configured to receive a corresponding upright flange guide.

14. The apparatus of claim 1, wherein the steering assembly further comprises an electric drive means for selectively engaging and disengaging the upright flange guides with the respective opposing axle ends.

15. The apparatus of claim 14, wherein the electric drive means is a servo motor.

16. The apparatus of claim 1, wherein the steering assembly includes an axle locking-bar assembly and a servo motor having a rotatable shaft that rotates the axle locking-bar to selectively engage with the opposing axle ends.

17. The apparatus of claim 16, wherein the rotatable shaft extends along the longitudinal axis of the apparatus.

18. The apparatus of claim 16, wherein the locking bar assembly includes a cross-member having opposing ends, each of which terminating at one of the upright flange guides.

19. The apparatus of claim 1, wherein the opposing axle ends are from a common axle.

20. The apparatus of claim 1, wherein each opposing axle end is formed from a separate axle.

21. A robotic cleaning apparatus for cleaning a submerged surface of a pool or tank comprising:

a housing having a front portion and opposing rear portion, and a base portion with at least one water inlet;

a water pump configured to draw water and debris from the pool or tank through the at least one water inlet for filtering and discharging filtered water through at least one water-discharge outlet to propel the cleaning apparatus in the pool or tank;

rotationally-mounted supports coupled proximate at least one of the front and rear portions of the housing, said rotationally-mounted supports including a pair of rotationally-mounted supports each of which is coupled to an opposing end of an axle, the opposing axle ends being slidably moveable along the housing forwardly and rearwardly relative to the directional path of the cleaner;

an electronic controller operable to automatically control positioning of each end of the axle relative to the housing to steer the cleaning apparatus in a controlled pattern while the cleaner is moving in a forward or reverse direction; and a steering assembly responsive to control signals received from the controller, the steering assembly comprising an upright flange guide positioned proximate to each of the respective opposing axle ends and having a top surface that selectively engages with and disengages from the corresponding axle end.

* * * * *